US006336256B1

(12) United States Patent
Näf et al.

(10) Patent No.: US 6,336,256 B1
(45) Date of Patent: Jan. 8, 2002

(54) APPARATUS FOR THE ENTRY OF A FIBER BAND INTO A STRETCH MACHINE

(75) Inventors: Beat Näf, Jona; Lars Weisigk, Winterthur, both of (CH)

(73) Assignee: Rieter Ingolstadt Spinnereimaschinebau AG, Ingolstadt (DE)

( * ) Notice: Subject to any disclaimer, the term of this patent is extended or adjusted under 35 U.S.C. 154(b) by 0 days.

(21) Appl. No.: 09/512,492

(22) Filed: Feb. 24, 2000

(51) Int. Cl.[7] ..... D01B 3/04
(52) U.S. Cl. ..... 19/65 A; 19/157; 19/239
(58) Field of Search ..... 19/65 A, 98, 236, 19/240, 246, 258, 260, 266, 150, 157

(56) References Cited

U.S. PATENT DOCUMENTS

| | | | | | |
|---|---|---|---|---|---|
| 707,874 | A | * | 8/1902 | Stevens | 19/157 |
| 1,313,164 | A | * | 8/1919 | Casablancas | 19/150 |
| 2,079,122 | A | * | 5/1937 | Lawton | 19/157 |
| 2,091,153 | A | * | 8/1937 | Martin | 19/157 |
| 2,203,423 | A | * | 6/1940 | Walsh et al. | 19/157 |
| 2,272,787 | A | * | 2/1942 | Bentley | 19/157 |
| 2,450,251 | A | * | 9/1948 | Noguera | 19/157 |
| 2,683,290 | A | * | 7/1954 | Noguera | 19/157 |
| 2,735,141 | A | * | 2/1956 | Tarbox | 19/157 |
| 2,758,341 | A | * | 8/1956 | Noguera | 19/157 |
| 2,879,551 | A | * | 3/1959 | Hunter | 19/157 |
| 2,953,823 | A | * | 9/1960 | Lynch, Jr. | 19/157 |
| 3,822,590 | A | * | 7/1974 | Tharpe et al. | 19/239 |
| 5,016,322 | A | | 5/1991 | Erni et al. | |
| 5,400,476 | A | * | 3/1995 | White | 19/239 |
| 5,461,757 | A | * | 10/1995 | Leifeld | 19/239 |
| 5,630,251 | A | * | 5/1997 | Leifeld | 19/239 |
| 5,839,165 | A | | 11/1998 | Patelli et al. | |
| 5,983,456 | A | * | 11/1999 | Leifeld | 19/239 |
| 6,119,312 | A | * | 9/2000 | Leifeld | 19/65 A |

FOREIGN PATENT DOCUMENTS

| | | |
|---|---|---|
| CH | 140058 | 6/1929 |
| CH | 145942 | 1/1930 |
| DE | 907274 | 7/1949 |
| DE | 940433.7 | 8/1994 |

OTHER PUBLICATIONS

German Patent Office Search Report, Oct. 7, 1999.

* cited by examiner

*Primary Examiner*—Danny Worrell
*Assistant Examiner*—Gary L. Welch
(74) *Attorney, Agent, or Firm*—Dority & Manning, P.A.

(57) ABSTRACT

The object of the invention is to facilitate the entry of a fiber band into a drawing machine. The invention is comprised of a fiber band insertion apparatus having a combination condenser and guide device with a longitudinal slot extending over its entire length. The guide device is followed by roll pair, which, at least during the laying in of the fiber band, has an accessible entry opening. This opening is at least partially formed by a recess in at least one of the opposed sides of the roll pair. The recess is separated by a flange on one of the circumferential rim surfaces which are mutually profiled to provide space for a compression line for the fiber band. The entry opening of the roll pair and/or feeders, as well as the entry slot of the condenser are, essentially, arranged in a common plane. With the aid of the invented apparatus, the fiber band is laid into the band entry device by a movement transverse to the normal transport direction of the fiber band when the drawing machine is running.

19 Claims, 3 Drawing Sheets

APPARATUS FOR THE ENTRY OF A FIBER BAND INTO A STRETCH MACHINE

BACKGROUND OF THE INVENTION

The present invention concerns an apparatus for the insertion of a fiber band into a drawing machine with a band entry apparatus exhibiting a condenser that possesses an insertion opening over its entire length as well as a process for using such an apparatus.

In the practice, increasing efforts are taken to automate the transport of cans between a carding machine and a drawing machine or even to dispense with such can transport. Relative to this purpose, it is necessary to adjust the operations of the carding machine and the drawing machine to one another. Otherwise, breakage or run-out of the fiber band being led to the stretch machine can occur. Thus, it is necessary to thread the fiber band into a guide funnel, so that the fiber band can be subsequently automatically led to a following drawing machine. This threading of the fiber band is difficult to do by hand and is also time consuming. Further, the drawing machine to which the fiber band is to be inserted must be shut down.

OBJECTS AND SUMMARY OF THE INVENTION

It is therefore a principal object of the present invention to avoid the designated disadvantages and to create an apparatus as well as a process, which help a fiber band can to be introduced into a drawing machine, without shutting down the drawing machine. Additional objects and advantages of the invention will be set forth in part in the following description or may be obvious from the description, or may be learned through practice of the invention.

The purpose stated above will be achieved by a band entry apparatus exhibiting a condenser that possesses an insertion opening extending over its entire length. Because the fiber consolidating condenser possesses an insertion slot, extending over its full length, it is not necessary to lay in the fiber band axially into the condenser. Moreover, the fiber band is grasped on both sides outside of the longitudinal length of the condenser, and is inserted from the side or from above into the insertion slot. In this way, the laying in of the fiber band can be accomplished very quickly.

The condenser, which is provided with an insertion slot, can be constructed in an optional manner and, for instance, can be made of several appropriately arranged rods or the like between which the fiber band is conducted in a compressing manner. Advantageously, the condenser may be designed as a guide funnel with a longitudinal slot serving as an insertion opening. This slot can be constructed to be capable of opening and closing, allowing the slot to be accessible for the insertion phase but otherwise can be covered. Advantageously, in attachment to the condenser, a feeder or even a roll pair may be provided, that follows the condenser. Further, depending upon the task to be carried out by the roll pair, at least one of the rolls may be a feeder roll and can be power driven.

It is advantageous if the fiber band intake apparatus possesses a band contact arrangement in connection with a control device, so that irregularities in the fiber band, which possibly were caused by the insertion procedure, can be again compensated for.

After a run-out of a fiber band already in the drawing machine, a re-entry of a fiber band into the band insert apparatus can lead to an interruption of the fiber band transport. To compensate for the interruption advantageously, a band storage loop in communication with the control device is provided before the insertion equipment. In this way, by an appropriate control of the drawing machine assurance can be given that the band storage does not exceed its capacity. After an executed reinsertion of the band in the band feed apparatus, the storage is reduced to a specified minimum buffer content.

In an advantageous improvement of the object of the invention a provision can be made that the band contact device makes use of measuring rolls.

So that the insertion of the fiber band into the compression space between two rolls is made easier, the rolls of the roll pair which may interengage with one another by means of radially extending side provides may possess at least partially shielded, circumferential surfaces between which the fiber band is guided, and which exhibit an entry opening that is accessible at least during the insertion of the fiber band. Correspondingly, a further practical development of the invented apparatus allows the insertion opening to be made larger by means of a movable bearing arrangement of one of the rolls of a roll pair additionally easing the insertion of the fiber band in the rolls.

More advantageously, the insertion slots of the condenser and further elements of the band feed apparatus are disposed in a common plane, which allows introducing the fiber band into the mechanism of the band feed apparatus by a simple, single movement. A further simplification of the insertion of the band into a band feed apparatus may be achieved by a band guidance means which is in the same plane as the entry opening.

With the assistance of the apparatus in accord with the present invention, the above stated purpose can be achieved with an invented process of having the fiber band introduced into the band feed apparatus transverse to the normal fiber transport direction without shutting down the operating parts.

The apparatus essentially leads to a simplification of the band insertion, which is predicated on no stopping of the drawing machine and is carried through in minimal time. In spite of this, it is not necessary to join the end of a fiber band to be inserted with the end of an already running fiber band. For the band insertion, no expensive, complex changes in the area of the drawing machine need be undertaken, so that already existing equipment can be re-equipped at favorable cost without any great material provision nor loss of time. Moreover, on the grounds of the simple course of the movements, the process in accord with the invention can be easily automated.

Embodiment examples of the invention are described below in greater detail with the aid of the drawings.

DETAILED DESCRIPTION

Reference will now be made in detail to the presently preferred embodiments of the invention, one or more examples of which are shown in the figures. Each example is provided to explain the invention and not as a limitation of the invention. In fact, features illustrated or described as part of one embodiment can be used with another embodiment to yield still a further embodiment. It is intended that the present invention cover such modifications and variations.

Figure 1:
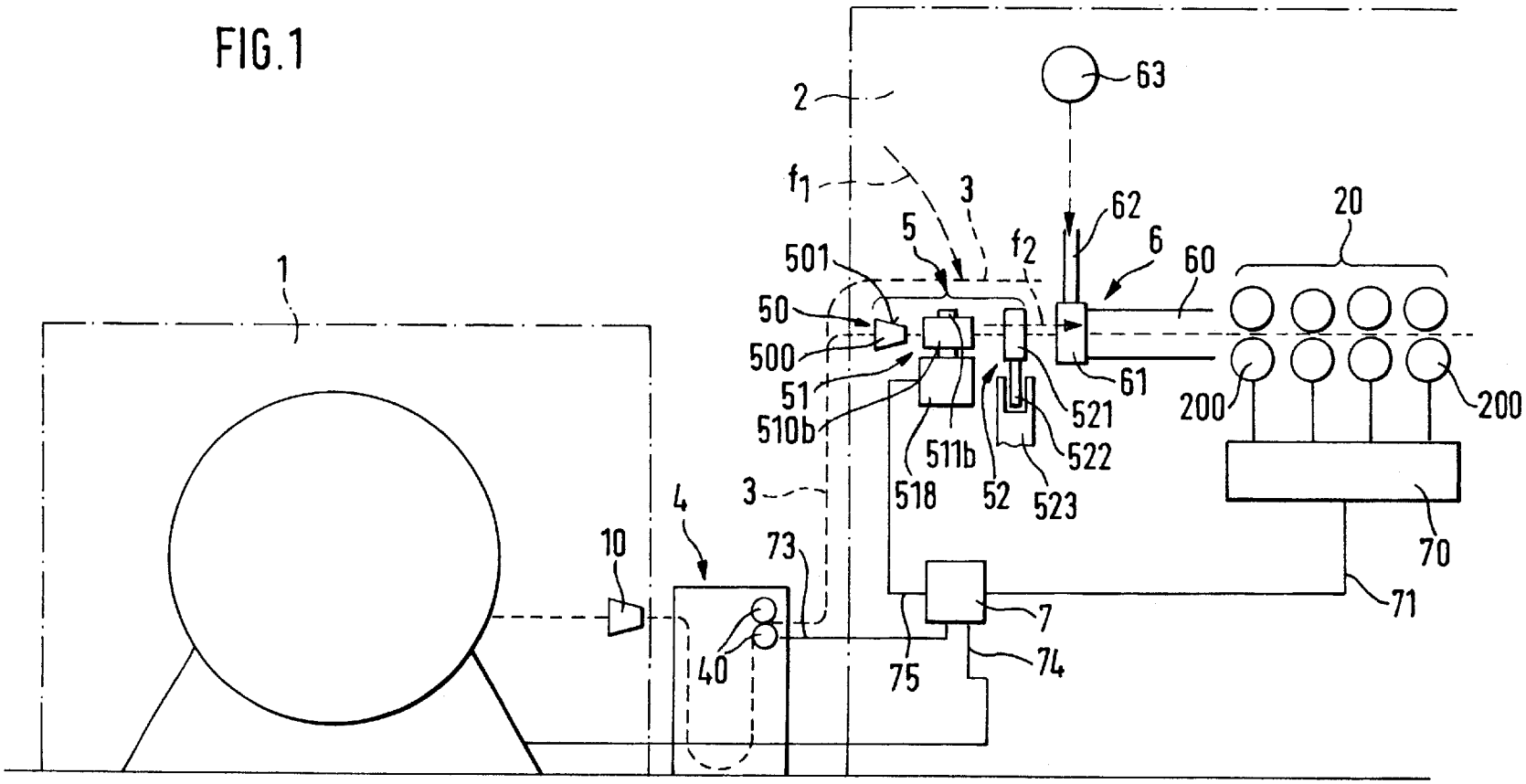
FIG. 1 shows a textile machine arrangement with a carding machine and a drawing machine as well as an invented band entry apparatus in a schematic profile view.

FIG. 1 shows, in a schematic view, a machine arrangement of group of machines, which are comprised generally of a carding machine 1 and a drawing machine 2.

The carding machine 1 can be of conventional design, on which account, in FIG. 1 the duplication of further details has been dispensed with. At the product exit end of the carding machine 1, the fiber band runs through a band funnel 10 followed by a band buffer storage 4. Also, this band storage 4 is principally shown in a schematic manner and can be of any conventional design. In FIG. 1, at the discharge end of the band storage 4 is shown a driven roll pair 40. Again, depending upon the design of the band storage 4, this roll pair 40 may be dispensed with.

Subsequent to the band storage 4, the fiber band reaches the drawing machine 2. As is shown, this drawing machine can be so designed, that it is, essentially, drawing a singe fiber band 3 (shown as a dotted line). The drawing machine can, however, be constructed for doubling for a plurality of fiber bands (not shown). For the one fiber band (or for each fiber band), the drawing machine 2 on its feed end possesses a band entry apparatus 5, which, in the same manner as above, can be built in accord with various designs, as will be described later, and thereby be composed of the combination of different elements or components. In accord with the depicted embodiment shown in FIG. 2, the band entry apparatus 5, as seen in the direction of the travel of band 3 (see direction $f_2$), is comprised basically of a condenser 50, a roll pair 51 and a band guide 52.

In the direction of the fiber band travel, following the band entry apparatus 5, drawing unit 20 is found a stretch works 20 to which a suction apparatus 6 can be attached as is shown in the embodiment illustrated in FIG. 1.

In order to shape the fiber band 3 in a more compact form for its later drawing or doubling in the drawing unit 20, the fiber band 3 must pass through a consolidating condenser 50, which again can be fashioned in various ways. In accord with FIGS. 1, 2, the condenser 50 is constructed as a guide funnel 500, which, on its visible upper side 501, possesses a longitudinal slot 502 that extends over the total length of the guide funnel 500.

Figure 2:
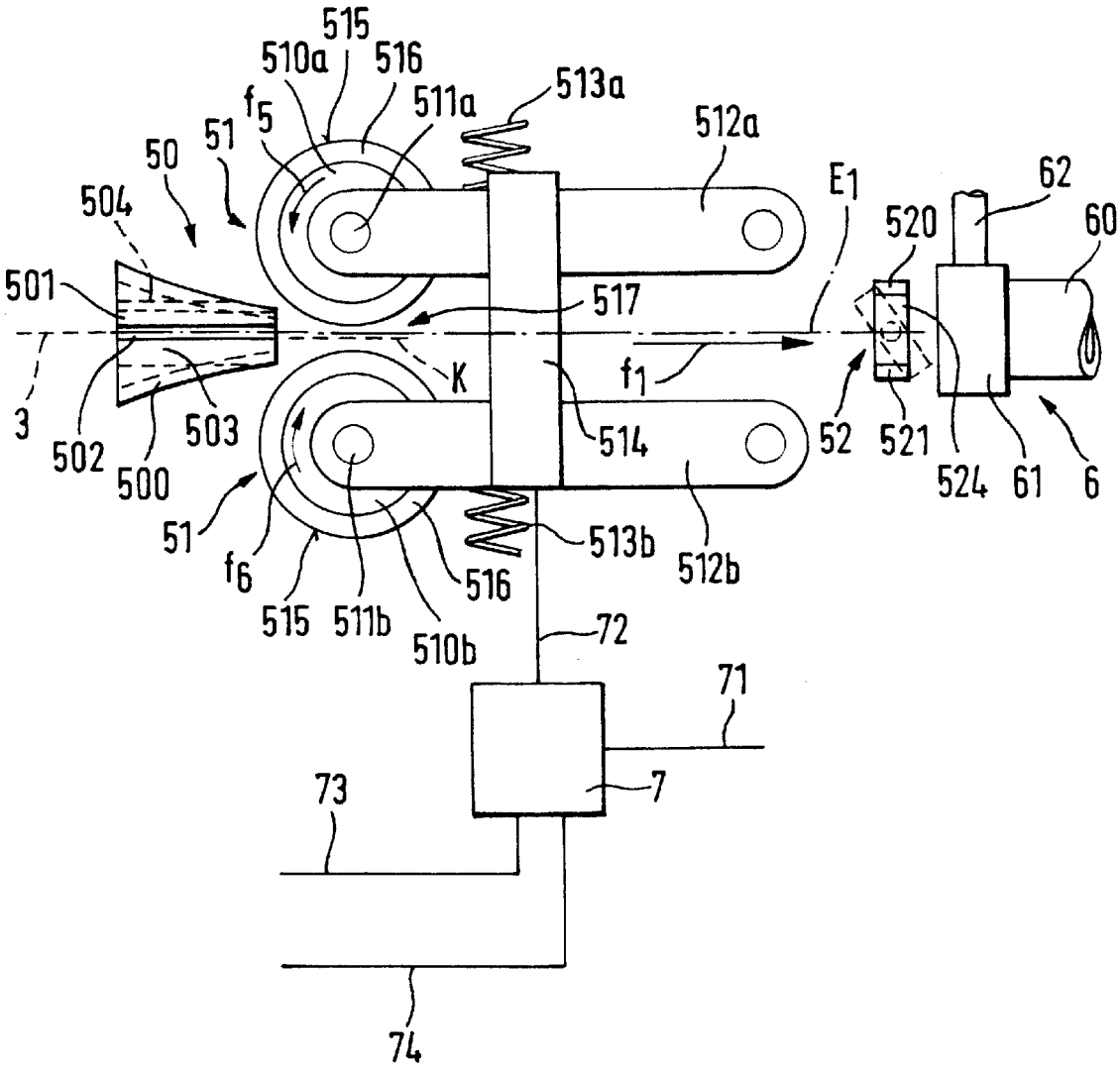
FIG. 2 shows a band entry apparatus, in accord with the invention, seen in plan view.

As FIG. 2 shows, each of the two rolls 510*a* and 510*b* of the roll pair 51 is set in bearings on swingable lever arms 512*a* and 512*b* with the aid of axles 511*a* and 511*b*. Each arm 512*a* and 512*b* is loaded by a compression spring 513*a* and 513*b*, wherein these compression springs 513*a*, 513*b* are supported by an abutment not shown. By means of this spring loading, the two rolls 510*a*, and 510*b* are pressed toward one another and compress the fiber band 3 between them in conventional manner (see FIG. 1). For this reason, in spite of the schematic presentation of the fiber band as a dotted line in FIG. 2, an open space is shown between the two rolls 510*a* and 510*b*. As will be later explained, the roll pair 51 can be passively driven by the fiber band 3 or be actively driven by a motor 518 as this is shown in FIG. 1.

In accord with the embodiment example shown in FIG. 2, the two rolls 510*a* and 510*b* are designed as measuring rolls of fiber band thickness. For this purpose, the arm 512*b* carries a sensor 514, which, in a conventional manner and hence not further described, works together with the arm 512*a*. The sensor is in communication over a connecting line 72 with a control device 7.

The band guidance 52 possesses a fork shaped design and exhibits two guide prongs 520 and 521. Between the two prongs, an entry opening 524 exists in which the fiber band 3 traveling to the drawing unit 20 is guided. As shown in FIG. 1, the band guidance 52 with its bearing bolts 522 is turnably seated in an axial bearing 523.

The suction apparatus 6 shows, in the depicted embodiment example, a tube 60, which extends itself to the entry side of the drawing unit 20. On the entry side of the suction apparatus 6, the tube 60 is encapsulated by a pressurized air chamber 61. The pressurized air chamber 61 is in communication with the interior space of the tube 60 by means of perforations to transmit pressurized air (not shown), which, in turn, respectively exhibit a directional component in the fiber band transport direction $f_2$. This arrangement induces an air flow oriented toward the drawing unit 20. The pressurized air chamber 61 is connected to its source of pressurized air 63 by air line 62.

The drawing unit works is of conventional design, wherein each of the driven cylinders 200 is connected to a regulator 70. This regulator, in turn, communicates over a control line 71 with the already mentioned control apparatus 7. Besides this regulator 70, the control apparatus 7 is controllably connected with:

- the already mentioned sensor 514, generally without the (not shown) drive of the two rolls 510*a* and 510*b;*
- the roll pair 40 at the exit of the band storage 4 (over control line 73);
- the (not shown) drive of the carding machine 1 (over control line 74);
- and, if necessary, with the drive 518 for roll pair 51 (over control line 75).

Let it be assumed, that the fiber band transport to the drawing unit 20, for whatever reason, has been interrupted. So long as a specified fiber band length remaining in the intermediate buffer storage 4 is not exhausted, the carding machine 1 will continue to operate further, during which operation the delivered fiber band 3 will continue to be stored in the fiber band storage 4.

Upon the interruption of the fiber band transport a corresponding optical or acoustic signal is released in conventional manner, so that an operating person is made aware of the state of this machine equipment. The operating person hastens on this account to the fiber band storage 4 and seizes the front end of the fiber band 3, which protrudes from the band storage 4 or from a (not shown) following element.

Now, the fiber band 3 is to be inserted into the condenser 50. In the case of previous insertions up to this time for which no longitudinal slot was available, this insertion was done in such a manner that the fiber band 3 was entered by thrust in an axial direction into the guide funnel 500 and was pushed on through the guide funnel until the fiber band 3 was laid into the roll pair, which followed the guide funnel 500. To accomplish this, the roll pair were brought to a stop as is also required of the drawing unit 20. Only when the fiber band 3 is between the roll pair and, if necessary, in the drawing unit 20 can the drawing unit and the roll pair be placed back in operation.

For the axial threading of the fiber band 3 into the condenser 50, the end of the band must be made into a sharp tip. Furthermore, axial motion must be imparted to the band by the operating person during the insertion thereof, since, on that part of the machine, the driving means is shut down during this reinsertion work. This threading and manual insertion of the fiber band 3 is, as is evident from the described grounds, complex and painstaking and, moreover, very time consuming.

In the case of the present fiber band insertion apparatus 5 now described in its construction, in a manner contrary to the above, the insertion of the band into this insertion apparatus and its complementary equipment is not carried out as is indicated with the aid of arrow $f_1$ in FIG. 1 in the fiber band travel direction (arrow $f_2$), but transverse thereto. In order to achieve this, the single components of the fiber band insertion apparatus 5 are designed in a special manner as previously has been more closely described with the help of FIG. 2. Since the condenser 50 designed as a guide funnel 500, is equipped with an opening, for instance, in the form of a longitudinal slot 502, the laying in of the fiber band 3 can be carried out with the aid of a uncomplicated insertion movement oriented generally transverse to the transport (see arrow $f_2$) direction.

The operating person, for the insertion of the fiber band 3 into the band insertion apparatus 5, lifts the forward end of the fiber band 3 and holds this over the band insertion apparatus 5. At this point in the insertion, the operating person depresses the fiber band 3 at its forward end in such a manner that this end finds itself directly before the entry opening of the suction apparatus 6, which is encapsulated by the pressurized air chamber and under air pressure. The leading end of the fiber band 3 now finds itself reacting to the air flow through the tube 60 of the suction apparatus 6, which seizes the fiber band 3. Simultaneously, the operating person depresses the leading end of the fiber band 3 and runs this from above (relative to the presentation shown in FIG. 1) into the band entry apparatus 5, which will be described in the following in detail.

The transport of the fiber band 3 into the drawing unit is made certain by this method of band insertion. The band storage 4 has means for displaying the excess of fiber band which is stored therein, so that the control apparatus 7 can deliver a corresponding signal to the drawing unit regulator 70. Regulator 70 then runs the drawing unit 20 at such speed that, while maintaining a desired storage delay, any fiber band excess is depleted to a specified minimum quantity. Upon reaching this quantity, the control apparatus 7 is signaled thereof by the band storage 4. Control apparatus 7, in turn, signals the regulator 70, which then runs the drawing unit at a correspondingly slower pace.

The insertion of the fiber band 3 in the band entry apparatus 5 is carried out in such a manner that the leading fiber band end is brought into its normal transport path (see arrow $f_2$), before the same happens to the remaining fiber band section which is to be brought into the band insert apparatus 5.

The fiber band 3 is first guided into the entry opening 524 (FIG. 2) between the guide prongs 520 and 521 of the fork shaped band guidance 52. This guiding presents no problem. Since the band guidance 52 is pivotably supported on bearings, these can be swung somewhat out of the transport path during the insertion (see arrow $f_2$). This movement can be an advantage since, up to this time, the remaining fiber band section that is to be inserted into the band insertion apparatus is not yet placed in the preceding apparatus (roll pair 51 and condenser 50). The leading fiber band end confronts the entry opening of the suction apparatus 6 by the retraction of the band guidance 52. This retraction occurs at the latest, when, by the progression of the band insertion into the band entry apparatus 5, the fiber band 3 assumes position in the vertical plane E, which also includes compression line K (FIG. 2) of the roll pair 51 and the longitudinal slot 502 of the condenser that runs parallel within the plane.

After the placement of the fiber band 3 in front of the suction apparatus 6, that is, placement in the band guide 52, the intervening section of fiber band 3 is laid into the condenser 50. Since the depicted condenser 50 is designed as a guide funnel 500 and possesses a longitudinal slot 502, this insertion is possible by means of a lowering of the fiber band 3, which has, up to now, been held above in the plane $E_1$.

If the roll pair 51 possesses two rolls 510*a* and 510*b*, which principally operate together with their circumferential surfaces 515, then, for the insertion of the fiber band 3 in the compression line K (FIG. 2) of the roll pair 51, an entry opening 517 is necessary. In order to form this, it is sufficient if the circumferential surfaces 515 of the two rolls 510*a* and 510*b* possess offset edges in the form of bevels 516. Because of the tension in the fiber band 3 and the fact that the fiber band 3 before and after the roll pair 51 is positioned deeper than the bevels 516, the fiber band 3 is taken in through the entry opening formed by the bevels 516. The direction of rotation (see arrows $f_5$ and $f_6$ in FIG. 2) of the rolls 510*a* and 510*b* and the inclined positioning of the fiber band 3 guided to the roll pair 51 causes the fiber band gradually to be drawn into the compression line K of the roll pair 51. This drawing in of the fiber band 3 into the compression line K is carried out independently as to whether the rolls 510*a* and 510*b* are rotated passively by the fiber band 3 that is being pulled through the drawing unit 20, or if the rolls are actively power driven, thus acting as a feeder. In the latter case, a drive 518 is provided that is controllingly connected to the control device 7 by line 75.

The object of the invention is not limited to the above described constructions, but can be altered within the framework of the present invention in a multiplicity of ways, principally by the exchange of features by equivalents or by other combinations of features. Thus the condenser 50, if it is functioning as a guide funnel 500, can, for instance, exhibit a longitudinal slot 502, which is held closed by a cover 503 (see the dotted presentation thereof in FIG. 2). For the insertion of the fiber band 3, the cover 503 is opened. In this respect, the cover 503 can be an independent part of the guide funnel 500 that is designed to be removable, or it can be pivotable. These configuration allow the release of the longitudinal slot 502 to be done respectively by removal or swinging away of the cover 503. FIG. 2 shows, for instance, a hinge 504 extending itself parallel to the longitudinal slot 502 (see dotted line in FIG. 2) on which hinge the cover 503 is swingingly fastened.

In accord with yet another alternative embodiment of the guide funnel 500, the guide funnel possesses a longitudinal slot (now shown) tapered from the inside out, which further eases the insertion of the fiber band 3 into the guide funnel 500. Should such a widened longitudinal slot 502 possess insignificant length on the grounds of insufficient material thickness of the guide funnel 500, and thereby evidence no essential effect, then the longitudinal slot 502 can be lengthened by guide surfaces (not shown) placed upon the guide funnel 500. Guide surfaces of this kind are extensions of the walls which form the longitudinal slot 502 and increasing widen the slot as they extend away from the guide funnel 500, so that these guide surfaces form on both their exposed ends, open funnels (not shown).

In order to be assured that the fiber band 3 can neither entirely nor partially leave the guide funnel in an undesirable way, the longitudinal slot 502 where the distance of separation of the slot walls which border it is concerned has to be correspondingly narrow dimensioned. For this purpose, an alternative construction variant of an entry guide funnel (now shown) provides no straight line guide surfaces. Such surfaces are made in spiral shapes and enclose between them a spiral shaped, entry space, widening the longitudinal slot 502 from the inside to the outside. In the case of a spirally designed entry space, the outer end thereof, into which the fiber band 3 is to be laid, is located in a common plane E, with the insert slot, or additional elements or components of the fiber band entry apparatus 5. This set-up allows the insertion of the fiber band 3 to be in no way made more difficult concerning this spiral shaped entry space as compared to the previously described starting position. Moreover, in this spiral way, tension variations in the to-be-stretched fiber band 3 cause this band to in no way move in or out of the guide funnel 500 in an undesirable manner, either partially or entirely, wherein the fiber band 3 can suffer undesirable damages.

Figure 4:
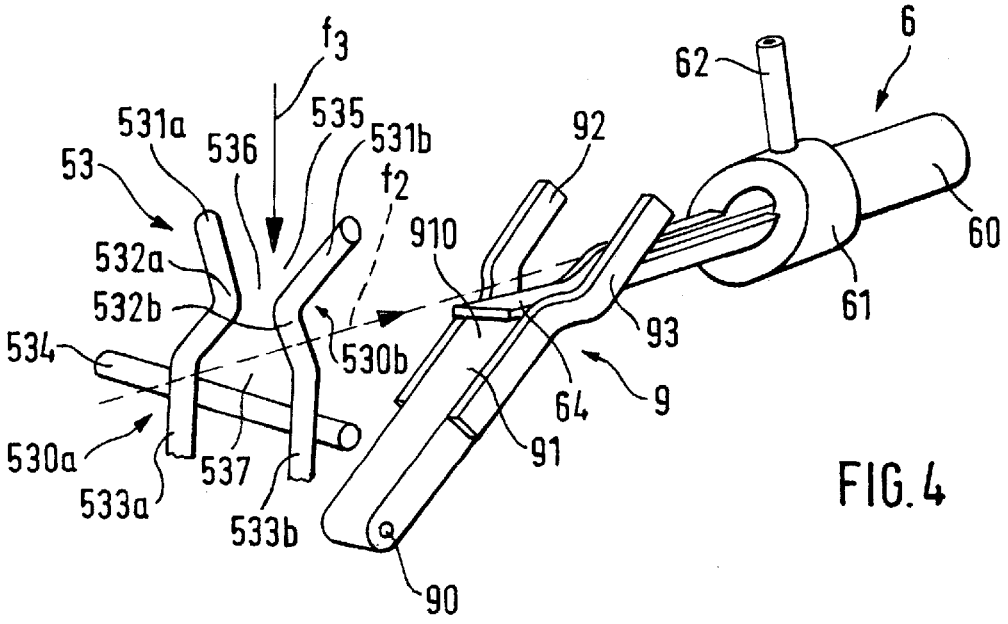
FIG. 4 shows a modified version of the condenser as well as of the feeding device in accord with the invention, shown in a perspective presentation.

The condenser 50 does not have to exhibit the shape of a guide funnel 500, but can be configured in various forms. An alternative embodiment of a condenser 53 is shown in FIG. 4, wherein, in accord with this Figure, the condenser 53 is comprised of a combination of three rods, 530*a*, 530*b* and 534. The two rods 530*a* and 530*b* are designed as mirror images of one another. The two ends 531*a* and 531*b* of the rods 530*a* and 530*b*, remote from the holding means of the device (not shown), are so inclined in reference to one another that their separating difference continually narrows in the direction of the holding means. In this manner, these ends 531*a* and 531*b* establish between one another an insert opening 535 (see arrow $f_3$) which correspondingly narrows itself. The two ends 531*a* and 531*b*extend into knees 532*a*, 532*b*, between which the rods 530*a* and 530*b* exhibit their closest, oppositely situated distance apart (narrow point 536). At this narrow point 536, the corresponding condenser 53 is formed, making passage 537 which is enclosed by the rods 530*a*, 530*b* and 534. It is within this passage 537 that the continual run of the fiber band 3 during an undisturbed operation is guided to the drawing unit 20. This guide passage 537 is peripherally bordered by two longitudinal sections 533*a* and 533*b* of the rods 530*a* and 530*b* that are essentially parallel to one another. The bar 534 is oriented transversely to these longitudinal sections 533*a* and 533*b*.

First, the fiber band 3 is laid into the condenser 53, not in its transport direction (see $f_2$) but transverse thereto, and through the entry opening 535 which movement is again correspondingly transverse along the arrow $f_3$ to the transport direction. Next, this having been done, it is now possible that there can be provided two respective condenser units, comprised each of the rods 530*a*, 530*b* and 534, which follow one another in the direction of the arrow $f_2$. In this case, in an advantageous manner, the enclosed guide opening 537 of the first of these two condenser units is larger than that of the second of these guide opening areas.

Figure 3:
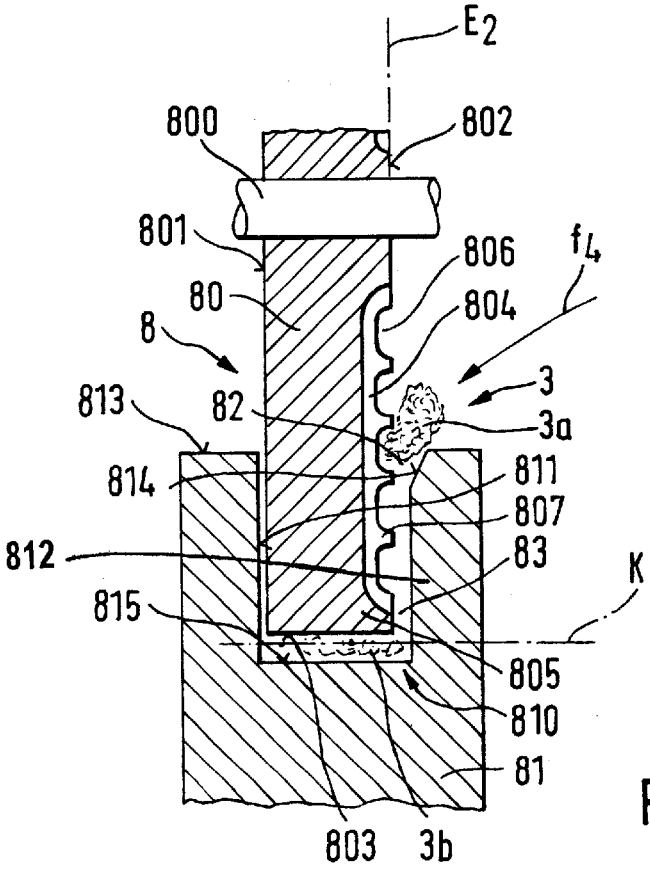
FIG. 3 shows a section view of a roll pair of the band entry apparatus.

Not only the condenser 50, or 53, but also the roll pair 51 can be designed in a different manner. FIG. 3 shows a modified roll pair 8, the two rolls 80, 81 of which enclose a horizontal compression line K between them. In spite of the specification of a horizontal arrangement of the axles (only the axle 800 of the upper roll 80 is shown) and by an unchanged arrangement of the condenser 50 or 53 as well as the fiber band 3 guide 52, even with this set-up, a vertical insert opening 82 is provided. In any case, before this insert 82, is further described, first the design of the roll pair should be presented in more detail.

The lower situated roll 81 of FIG. 3 is designed as a step-roll and possesses a circumferential groove 810 into which the upper roll 80 engages itself. As seen in FIG. 3, the right side of the roll pair 8 is the band insert side, which is illustrated by the arrow $f_4$ that symbolizes the insert direction of the fiber band 3. On the opposite side from this insert side of the roll pair 8, the outer radial surfaces 801 and 811 of the rolls 80 and 81, respectively, play no special part, since they have no other purpose to fulfill except the guidance of the upper roll 80 by the under roll 81. Contrary to this, it is a different situation with the mutually interacting radial surfaces 802 and 812, which are on the insertion side of the roll pair 8. With sufficient axle play between the circumferential surface 813 and the radial surface 812, in some circumstances, a bevel 814 on the roll 81 can suffice at the transition zone between this circumferential surface 813 and the radial surface 812 to assure a quick and secure placement of the fiber band 3 by the operating person through the insert opening 82. The fiber band 3, thus, is laid in the insert opening 82 (see position 3*a*). Now, because of the tension pull, which is induced following the seizing of the fiber band 3 by of the drawing unit, the fiber band 3 is drawn deeper into the entry opening 82 and into the space 83 between the radial surfaces 802 and 812 of the two rolls 80 and 81. The fiber band goes deeper until it is finally in the compression line K between the circumferential surface 803 of the upper roll 80 and the circumferential surface 815 within the circumferential groove 810 of the under roll 81 (see the dotted line depiction 3*b* of the fiber band 3).

The transfer of the fiber band 3 out of its position 3*a* in the entry opening 82 into its position 3*b* in the area of the compression line K between the circumferential surfaces 803 and 815 of the two rolls 80 and 81 (respectively) can be supported by additional measures. In accord with FIG. 3, as such a further measure, a recess 804 in the radial surface 802 of the upper roll 80 is provided. By the recess 804, a greater distance is created between the radial surfaces 802 and 812, which facilitates the insertion of the fiber band 3 into this space. This can yet be enhanced in that, on the upper roll 80, a profiling of a particular kind in the form of a protuberance (not shown) is provided. The protuberance, however, does not extend beyond the plane $E_2$ occupied by the radial surface 802. Upon the rotation of the roll 80, this protuberance moves into contact with the fiber band 3, which now finds itself in the position 3*a*, and, upon further rotation of the roll 80, moves the fiber band into the position 3*b*. These protuberances can, for instance, be provided respectively between two sequential recesses 804 or limit themselves to the two ends of a recess 804, which recess extends itself over the greater part of the circumference of the radial surface 802 of the roll 80.

FIG. 3 shows a further embodiment of an upper roll 80, in accord with which the recess 804 in the radial surface 802 of the upper roll 80 has a ring shaped design. This ring shaped recess 804 does not border on the circumferential surface of the roll 80, but is separated from this by a flange 805. The flange 805 needs to be only slightly narrow and has the purpose to fulfill, that the upper roll 80, in the area of the compression line K, has the widest possible circumferential surface 803 for the guiding of the fiber band 3, which finds itself in the position 3*b*.

If, in a design of this type of the upper roll 80, a profiling be desired, which would transfer the fiber band 3 more quickly out of the position 3*a* into the position 3*b*, then protuberances or the like can be provided. For this purpose, the flange 805 is provided with at least one groove 806 or the like. In FIG. 3, not only a single groove 806 is shown, but a plurality of such grooves, which are separated from one another by a cam-like come-along projection 807.

The cam or cams 807 operate in the same manner as the previously described protuberances, yet with the advantage that the fiber band 3, by means of the cam or cams 807 provided above the flange 805, is drawn farther into the space between the two radial surfaces 802 and 812. Also, the fiber band 3 is transported directly out of the position 3*a* into the position 3*b* by means of cam or cams 807 to the base of the groove 810 and into the space between the two circumferential surfaces 803 and 815.

An advantage is also found here, if, opposite from the recess 804, the roll 80 possesses a bevel 814 at the transition from the outer circumferential surface 813 of the roll 81 to its radial surface 812 opposite the recess 804.

The step-wise built rolls 80 and 81 of the roll pair 8 can be designed in a different manner. Thus, it is not unconditionally necessary that the upper roll 80 is guided between two radial surfaces 811 and 812. Conversely, the upper roll 80 can guide the lower roll 81 between two radial surfaces (this is not shown). Beyond this, the most varied designs can come into use with the most different widths and heights, if it is shown to be necessary for the interlocked rolls 80 and 81 to be correspondingly attuned to one another. Likewise, entry opening 82 is correspondingly to be made to accommodate the requirements of a current application.

The designed profiles formed by the two (or of the one) rolls 80 and 81 interlock with one another, at least partially, independently from the special roll construction. In this way, care is taken for an axial guidance of the rolls 80 and 81, and at the same time, the profiling protects, at least partially, the area of the compression line K (see FIG. 3). Again, the profiling attends to an assured guidance of the fiber band 3 between the corresponding circumferential surfaces (see, for instance, the circumferential surfaces 803 and 815) of the two rolls 80 and 81. In accord with FIG. 3, the insert opening 82 is continually accessible for the operating person. Still, under certain circumstances, provision can be made that this insert opening 82 can only be accessible by a more or less forceful lifting of the correspondingly movably supported roll (for instance, roll 80). This is because the recess 804, for instance, can only be released by the roll 81.

In case of necessity, the roll 81 can be prevented by a detent (not shown) on the lever 512*b* from following the movement of the other roll 80 for a lift beyond a given tolerance of lifting distance.

If a roll pair 51 or 8 is provided, then this pair can be a fiber band contact means and/or a feeder device. Independently from this, the pair can be horizontally (see FIGS. 1, 2) or vertically arranged. It is immaterial whether or not the motion for the insertion of the fiber band 3 is carried out in a vertical or horizontal direction. In principal, however, the orientation of the insert opening 517 of the roll pair 51, the orientation of the insert opening 82 of the roll pair 8, the location of the insert opening 535, or the insert opening formed by the longitudinal slot 502 must all be made to conform to the vertical or horizontal arrangement thereof.

In any case, provisions are made that the various insert openings 502 (longitudinal slot in the guide funnel 500) or 535, 82, 524, all of which are sequentially aligned in the direction of the fiber band 3 direction of travel, (see arrow $f_2$) are arranged generally in a common plane $E_1$. This arrangement allows the fiber band 3 to be laid into the various components of the band entry apparatus 5 with a simple movement.

It has already been indicated that the roll pair 51 can be designed as a part of a band contact apparatus and thus constructed as a measuring roll pair (see the indicated sensor 514 in FIG. 2). This is also true, in an analogous manner, for the depicted roll pair 8 in FIG. 3. For the function of a roll pair 51 or 8 as a part of a fiber band contact apparatus, it makes no difference as to whether the roll pair 51 or 8 are power driven or not.

It is not required that a driven roll, or indeed any roll pair 51 or 8, be provided as a band contact apparatus to enable the regulator 70 to effect compensation for thickness variances in the fiber band 3 that is to be drawn through the drawing unit 20. This is particularly true when these thickness variances are produced in the start-up insertion phase.

Other band contact devices (not shown) are to be considered, for instance, a wall of the condenser 50 may elastically support itself on the fiber band 3 and announces thickness changes over the control line 72 to the controller 7. The controller 7 may then relay corresponding command signals to the regulator 70 for the drawing machine 2.

In accord with the above described methods of construction and design, a roll pair 51 or 8 serves as a feeder, of which, respectively, at least one roll 510*a* or 510*b*, 80 or 81 is power driven. Still, the roll pair 51 or 8 does not need to be power driven and be a feeder, because other kinds of feeders are possible. Such a different feeder is shown in FIG. 4 and with the aid of this illustration is here described. This feeder 9 exhibits a lever 91 which is swingingly supported on a pivot axle 90, which, on its free end 910, exhibits two gripping elements 92 and 93 parallel to the transport direction of the fiber band 3. Between these two gripping elements 92 and 93, the fiber band 3 can be held by elastic retention. In accord with the embodiment shown in FIG. 4, the two gripping elements 92 and 93 are constructed to be mirror images of one another. The two elements are comprised of a elastic material or are flexibly supported. However, it usually suffices if only a single one of these gripping elements 92 or 93 is elastic in construction or flexibly supported. The other clamping element is rigidly bound with lever 91 and, if necessary, can be designed even as an integral part of this lever 91.

The two gripping elements 92 and 93, or corresponding other elements, have the purpose of seizing the fiber band 3 and holding it flexibly, while the lever 91 with its free end is in propinquity to the preceding components of the entry apparatus 5. Then, by means of a swinging motion about the axle 90 within the plane E, the device forwards the fiber band 3 toward the suction apparatus 6 of the drawing machine. The insertion of the fiber band 3 into the described feeder 9 is done in the same manner in which this was accomplished in connection with the band guide 52. The difference, however, is that the fiber band 3, upon being laid in place to be forwarded in the direction of the arrow $f_3$, is to be pushed so far into the feeder 9 that it is flexibly held by the feeder by means of the elastic retention.

In accord with FIG. 4, the suction apparatus possesses, in extension of a part of the circumferential wall of the tube 60, a separating web 64, which reaches into the pivoting zone of the clamping elements 92, 93, but does not, however, extend into the pivoting part of the lever 91 itself. If now, the feeder 9, with the inserted fiber band 3, is pivoted from its reception position into proximity of the components of the band entry apparatus 5 and toward the drawing unit 20, then the separating web 64 comes between the two clamping elements 92, 93 and pushes these apart from one another. Simultaneously, the fiber band 3 reaches its resting place on the separation web 64 and upon the forwarding of the pivot action of the lever 91 the band is lifted out of the elastic retention of the clamping elements 91, 93. Since the fiber band 3 finds itself in this position in the suction zone of the suction apparatus 6, it moves through the suction induced air flow into the drawing unit 20, so that the normal stretching procedure can be activated. The feeder 9 remains in the position in which it had released the fiber band 3 until, following another interruption of the fiber band transport, once again a new feed of the fiber band 3 to the drawing unit 20 becomes necessary.

As the preceding description indicates, the band entry apparatus 5 can be designed in various ways and exhibits other elements, which simultaneously fulfill a plurality of purposes. Thus, for example, the condenser 50 or 53 can be placed on the end of a pivoting feeder (not shown), which arrangement is similar to that of the feeder 9 which was described with the aid of FIG. 4. This condenser 50 or 53 can simultaneously fulfill the task of a condenser and a measurement device, as described previously, as well as a feeder. The elastic clamping function can be carried out, for instance, by an elastic element supporting itself on the fiber band 3, which serves also as a sensor for monitoring variations in the thickness of the fiber band.

In the least complex embodiment, the band insertion apparatus 5 exhibits principally a stationary condenser 50 or 53, which, as already explained, possesses an insertion slot (502 or 535).

According to the arrangement and design of the feeder, in some instances, a suction apparatus 6 can be dispensed with, since, by means of the feeder, or even by the operating person, the fiber band 3 can be directly inserted into the slowly moving drawing unit 20 without danger, during or before the fiber band 3 is laid into the band entry apparatus 5.

Because of the described construction of the band entry apparatus 5, the insertion of the fiber band 3 is carried out by means of a motion, essentially transverse to the direction of the fiber band transport direction (see arrow $f_2$). This insertion can be done manually or even with the aid of an automatic apparatus (not shown). The automatic apparatus seizes the protruding forward end of the fiber band 3 and, by means of a motion transverse to the normal fiber transport direction (see arrow $f_2$), lays this in the band insert apparatus 5. At the same time, in accordance with the feed apparatus of the stretch machine 2, the automatic apparatus lays the end directly at the suction apparatus 6 or directly to the drawing unit 20.

What is claimed is:

1. An apparatus for the entry of a fiber band into a drawing unit, said apparatus comprising:

a condenser disposed upstream from the drawing unit in a direction of travel of the fiber band to condense and guide the fiber band from a preceding process into the drawing unit, said condenser having longitudinally extending structure defining a passage through said condenser from a first side to an opposite second side disposed towards the drawing unit;

wherein said condenser further comprises a longitudinally extending opening in said structure from said first side to said second side, said opening being open and accessible along the length thereof in an operating mode of the drawing unit for insertion of the fiber band longitudinally into said condenser;

a fiber feed device disposed downstream from said condenser, said fiber feed device guiding said fiber band towards said drawing unit, wherein said fiber feed device is a roller pair, wherein at least one of the rolls in said roller pair is a driven feed roller;

a measuring apparatus disposed to continuously measure the density of said fiber band before it enters the drawing unit, wherein said measuring apparatus comprises a sensor configured with said roller pair; and wherein said regulator communicates through said control device with a storage unit for said fiber band, said storage unit being positioned after said preceding process and before said fiber band enters said condenser.

2. An apparatus for the entry of a fiber band into a drawing unit, said apparatus comprising:

a condenser disposed upstream from the drawing unit in a direction of travel of the fiber band to condense and guide the fiber band from a preceding process into the drawing unit, said condenser having longitudinally extending structure defining a passage through said condenser from a first side to an opposite second side disposed towards the drawing unit;

wherein said condenser further comprises a longitudinally extending opening in said structure from said first side to said second side, said opening being open and accessible along the length thereof in an operating mode of the drawing unit for insertion of the fiber band longitudinally into said condenser;

a fiber feed device disposed downstream from said condenser, said fiber feed device guiding said fiber band towards said drawing unit, wherein said fiber feed device is a roller pair; and wherein said rolls of said roller pair radially engage each other by having a first roll occupy a recess formed by radially extending outer circumferential surfaces of a second roll, said first roll forming an insertion opening to allow the fiber band to be guided between said roller pair.

3. An apparatus as in claim 2, wherein said condenser is a guide funnel having walls, said opening comprising a longitudinal slot defined in an upper said wall.

4. An apparatus as in claim 3, wherein said condenser possesses a cover which extends over said longitudinal slot, said cover being capable of opening and closing.

5. An apparatus as in claim 2, wherein said roller pair defines an insertion opening therebetween for easier introduction of said fiber band into said fiber feed device.

6. An apparatus as in claim 5, wherein one of the rolls of said roller pair is pivotal to allow easier insertion of said fiber band.

7. An apparatus as in claim 2, wherein at least one of the rolls in said roller pair is a driven feed roller.

8. An apparatus as in claim 7, further comprising a measuring apparatus disposed to continuously measure the density of said fiber band before it enters the drawing unit.

9. An apparatus as in claim 8, wherein said measuring apparatus comprises a sensor configured with said roller pair.

10. An apparatus as in claim 8, wherein said measuring apparatus communicates with a regulator for said draw frame by means of a control device.

11. An apparatus as in claim 2, wherein said first roll possesses a outer circumferential surface that serves as a band guiding rim, said outer circumferential surface is separated from said insertion opening formed by said first roll by a flange on said first roll.

12. An apparatus as in claim 11, wherein said flange aids in conducting said fiber band between said outer circumferential surface of said first roll and said recess formed by said second roll.

13. An apparatus as in claim 12, wherein said radially extending outer circumferential surface of said second roll, which faces said insertion opening formed by said first roll, defines a beveled edge away from said first roll to allow easier insertion of said fiber band.

14. An apparatus for the entry of a fiber band into a drawing unit, said apparatus comprising:

a condenser disposed upstream from the drawing unit in a direction of travel of the fiber band to condense and guide the fiber band from a preceding process into the drawing unit, said condenser having longitudinally extending structure defining a passage through said condenser from a first side to an opposite second side disposed towards the drawing unit;

wherein said condenser further comprises a longitudinally extending opening in said structure from said first side to said second side, said opening being open and accessible along the length thereof in an operating mode of the drawing unit for insertion of the fiber band longitudinally into said condenser;

a fiber feed device disposed downstream from said condenser, said fiber feed device guiding said fiber band towards said drawing unit; and further comprising a suction apparatus positioned between said fiber feed device and said drawing unit, said suction apparatus further aids in transporting said fiber band to said drawing unit.

15. An apparatus as in claim 14, further comprising a fiber band located between said fiber feed device and said suction apparatus,wherein said band guide possesses a fork shaped design with two guide prongs and a base, said band guide being pivotally disposed at said base to aid in aligning said fiber band for entry into said suction apparatus.

16. An apparatus as in claim 15, wherein said condenser, said fiber feed device, said band guide, and said suction apparatus are aligned in such a manner that said fiber band travels essentially in a common plane.

17. An apparatus for the entry of a fiber band into a drawing unit, said apparatus comprising:

a condenser disposed upstream from the drawing unit in a direction of travel of the fiber band to condense and guide the fiber band from a preceding process into the drawing unit, said condenser having longitudinally extending structure defining a passage through said condenser from a first side to an opposite second side disposed towards the drawing unit;

wherein said condenser further comprises a longitudinally extending opening in said structure from said first side to said second side, said opening being open and accessible along the length thereof in an operating mode of the drawing unit for insertion of the fiber band longitudinally into said condenser; and wherein said condenser compromising three rods with a first rod forming a base of said condenser situated perpendicular to fiber band flow direction, and two rods extending from said base perpendicular to said fiber band flow direction in which said two rods converge to a specified point and then diverge forming the other two sides of said condenser and said opening.

18. An apparatus as in claim 17, further comprising a fiber feed device disposed downstream from said condenser and containing a lever with a swingingly supported pivot axle, said pivot axle possessing two gripping elements for holding said fiber band by elastic retention parallel to said fiber band flow direction.

19. An apparatus as in claim 17, further comprising a suction apparatus disposed between said fiber feed device and said drawing unit, said suction apparatus having a separating web to separate said gripping elements and provide a resting place for said fiber band in front of said suction apparatus.

* * * * *